US007329814B2

(12) United States Patent
Hacker

(10) Patent No.: US 7,329,814 B2
(45) Date of Patent: Feb. 12, 2008

(54) ELECTRICAL CABLE

(75) Inventor: Jed Hacker, Brooklyn, NY (US)

(73) Assignee: Capricorn Audio Technologies Ltd, Ozone Park, NY (US)

( * ) Notice: Subject to any disclaimer, the term of this patent is extended or adjusted under 35 U.S.C. 154(b) by 0 days.

(21) Appl. No.: 11/322,193

(22) Filed: Dec. 29, 2005

(65) Prior Publication Data

US 2007/0151742 A1 Jul. 5, 2007

(51) Int. Cl.
*H01B 7/00* (2006.01)

(52) U.S. Cl. ..... 174/110 R; 174/113 R; 174/113 C

(58) Field of Classification Search ..... 174/28, 174/34, 36, 110 R, 113 R, 113 C, 113 AS, 174/115
See application file for complete search history.

(56) References Cited

U.S. PATENT DOCUMENTS

| | | | | |
|---|---|---|---|---|
| 3,815,054 | A * | 6/1974 | McClure et al. | 333/5 |
| 4,628,151 | A | 12/1986 | Cardas | |
| 4,654,476 | A | 3/1987 | Barnicol-Ottler | |
| 4,697,051 | A * | 9/1987 | Beggs et al. | 178/63 D |
| 4,731,506 | A | 3/1988 | Lee | |
| 4,777,324 | A * | 10/1988 | Lee | 174/34 |
| 4,837,405 | A | 6/1989 | Bonjour | |
| 4,873,393 | A | 10/1989 | Friesen | |
| RE33,750 | E | 11/1991 | Lee | |
| 5,298,680 | A * | 3/1994 | Kenny | 174/36 |
| 5,424,491 | A | 6/1995 | Walling | |
| 5,519,173 | A | 5/1996 | Newmayer | |
| 5,659,152 | A | 8/1997 | Horié | |
| 5,767,441 | A * | 6/1998 | Brorein et al. | 174/27 |
| 5,932,847 | A * | 8/1999 | Mayfield | 174/113 R |
| 6,096,977 | A | 8/2000 | Beggs | |
| 6,124,551 | A * | 9/2000 | Mattos et al. | 174/113 R |
| 6,194,663 | B1 | 2/2001 | Friesen | |
| 6,215,062 | B1 * | 4/2001 | Kimber | 174/27 |
| 6,323,427 | B1 | 11/2001 | Rutledge | |
| 6,355,876 | B1 | 3/2002 | Morimoto | |
| 6,452,094 | B2 | 9/2002 | Donner | |
| 6,495,761 | B1 | 12/2002 | Hacker | |
| 6,495,763 | B1 | 12/2002 | Eichmann | |
| 6,770,819 | B2 | 8/2004 | Patel | |
| 6,794,570 | B2 | 9/2004 | Chou | |
| 6,800,811 | B1 * | 10/2004 | Boucino | 174/113 C |
| 6,998,537 | B2 * | 2/2006 | Clark et al. | 174/113 R |
| 2005/0056454 | A1 | 3/2005 | Clark | |
| 2005/0121222 | A1 | 6/2005 | Lee | |
| 2005/0139378 | A1 | 6/2005 | Carlson | |
| 2005/0189135 | A1 | 9/2005 | Clark | |
| 2005/0205288 | A1 | 9/2005 | Fung | |

* cited by examiner

*Primary Examiner*—William H. Mayo, III
(74) *Attorney, Agent, or Firm*—I. Zborovsky

(57) ABSTRACT

An electrical cable has a first plurality of bundles each including a plurality of wires and connectable to a positive pole of a current source at one end, a second plurality of bundles each including a plurality of wires and connectable with a negative pole of the current source at one end. The bundles of the first plurality of bundles and the second plurality of bundles include bundles of same diameters, the wires in the bundles have different diameters, and the wires of the bundles are twisted in opposite directions so that the wires having a greater diameter are twisted in one direction, while the wires a smaller diameter are twisted in an opposite direction.

13 Claims, 3 Drawing Sheets

ELECTRICAL CABLE

BACKGROUND OF THE INVENTION

The present invention relates to electrical cables for transmission of current.

Electrical cables are known in many constructions and configurations. Usually, electrical cables are composed of a plurality of bundles each including a plurality of wires or strands. Some of such electrical cables are disclosed in U.S. Pat. Nos. RE33750, 4,628,151; 4,654,476; 4,731,506; 4,777,324; 4,837,405; 4,873,393; 5,424,491; 5,519,173; 5,659,152; 6,096,977; 6,194,663; 6,323,427; 6,355,876; 6,452,094; 6,495,761; 6,495,763; 6,770,819; 6,794,570; 6,825,410; 6,958,444; and U.S. Published patent applications Nos. 2005/0056454, U.S. 2005/0121222, U.S. 2005/0139378 A1, U.S. 2005/018913581, and U.S. 2005/0205288. It is believed that new cables can be further developed in order to improve their current transmission characteristics.

SUMMARY OF THE INVENTION

Accordingly, it is an object of the present invention to provide an electrical cable which is a further improvement of the existing cables.

In keeping with these objects and with others, one feature of the present invention resides, briefly stated, in an electrical cable which includes a first plurality of bundles each including a plurality of wires and connectable to a positive pole of a current source at one end; a second plurality of bundles each including a plurality of wires and connectable with a negative pole of the current source at one end, said first plurality of bundles and said second plurality of bundles includes bundles of same diameters, said wires in said bundles having different diameters, and the wires of said bundles are twisted in opposite directions so that the wires having a greater diameter of one bundle are twisted in one direction, while the neighboring wires having a smaller diameter of a neighboring bundle are twisted in an opposite direction.

When the electric cable is designed in accordance with the present invention, it has an increase current propagation speed, it is characterized by noise cancellation, and it possess a better quality for example for sound transmission.

In accordance with one embodiment of the present invention, the wires of the bundles in the first and second pluralities of bundles have increasing diameters in opposite directions, while in accordance with the other embodiment the wires of the bundles in the first and second pluralities of bundles have increasing diameters in the same direction.

In accordance with still a further feature of the present invention, a non-current conducting wire is located in a center of the electric cable between the first and second pluralities of bundles.

In accordance with still another feature of the present invention, the sheaths of the bundles are composed of different materials, and the cable jacket as well, so as not to form a single structure with negative effects.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
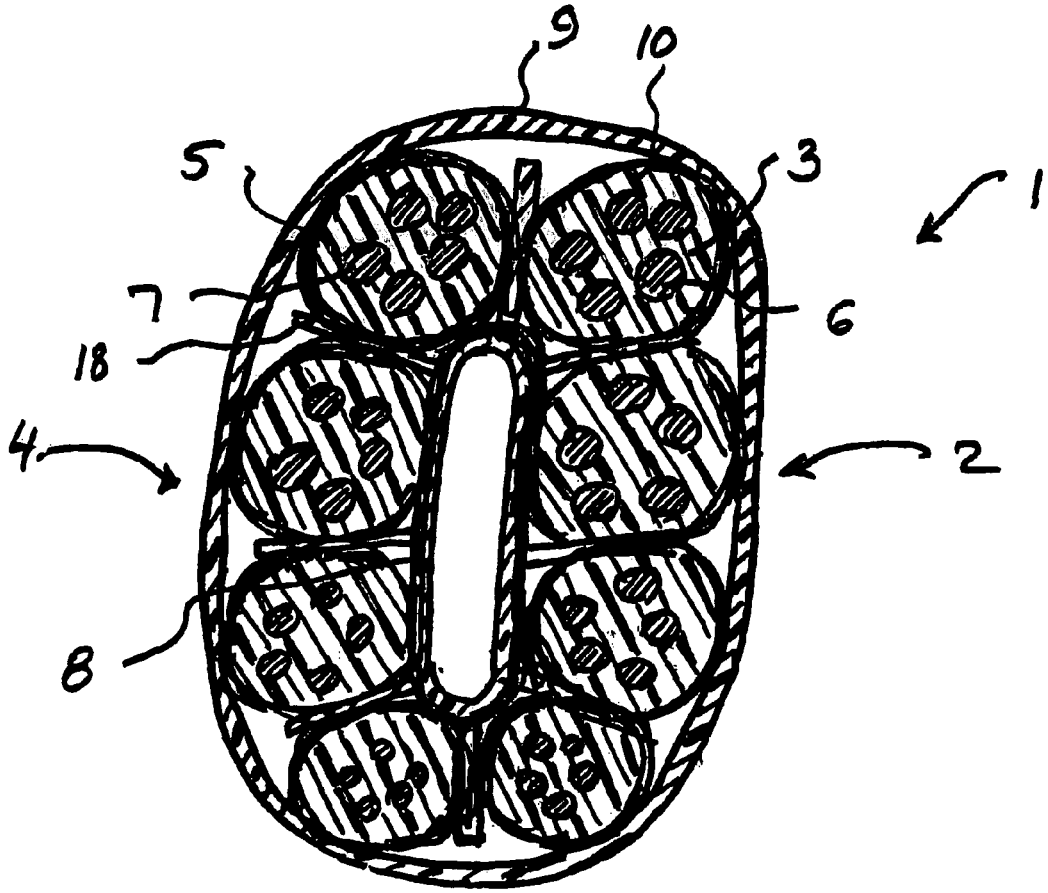
FIG. 1 is a view showing a cross-section of a cable in accordance with one embodiment of an electrical cable in accordance with one embodiment of the present invention.
Figure 2:
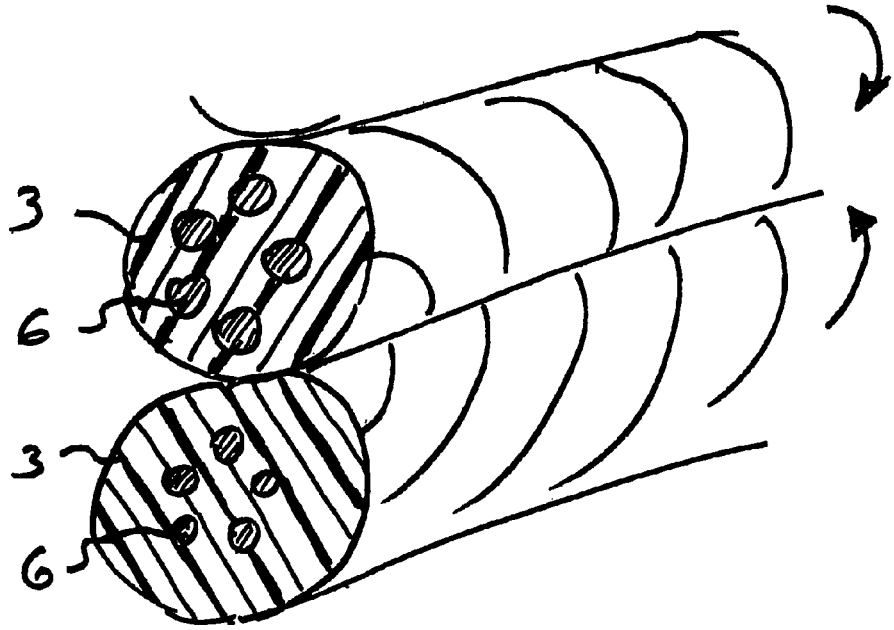
FIG. 2 is a view showing two neighboring bundles of the electrical cable in accordance with the present invention.

A cable in accordance with the present invention is identified as a whole with reference numeral 1. The cable 1 has a first plurality 2 of bundles having bundles 3 and connectable to one pole of current source, for example to a negative pole, and also a second plurality 4 of bundles having bundle 5 and connectable to another pole of the current source, for example to a positive pole. The opposite end of the cable and of all the bundles is connected to an electrical consumer.

In the cable 1 in accordance with the present invention the bundles 3 of the first plurality of bundles and the bundles 5 of the second plurality of bundles 4 have the same increasing diameter.

All of the bundles 3 and 5 in the pluralities of bundles 2 and 4 have a plurality of wires or strands which are identified correspondingly with reference numerals 6 and 7. In the cable in accordance with the present invention the number of wires in all bundles is substantially the same. However, the wires 6 and 7 in the bundles with the same diameter have different diameters.

A core 8 can be arranged in a center of the cable 1 between the bundles 3 of the first plurality of bundles 2 and the bundles 5 of the second plurality of bundles 4, for orderly arranging the bundles in the cable. The core 8 can be formed can formed as a solid core or as a core having a central opening.

The bundles and the core extend in the same direction of elongation of the cable and are substantially parallel to one another.

The cable in accordance with the present invention is provided with a jacket, as well known in the art, and identified with reference numeral 9.

Each of the bundles can be covered with a sheath which is identified with reference numeral 10.

In one embodiment of the present invention shown in FIG. 1 the diameter of the wires 6 in the bundles 3 in the plurality of the bundles 2 increases in one direction, for example in a counterclockwise direction, while the diameter of the wires 7 in the bundles 5 in the second plurality of the bundles 4 increases in an opposite direction, for example in a clockwise direction.

Figure 3:
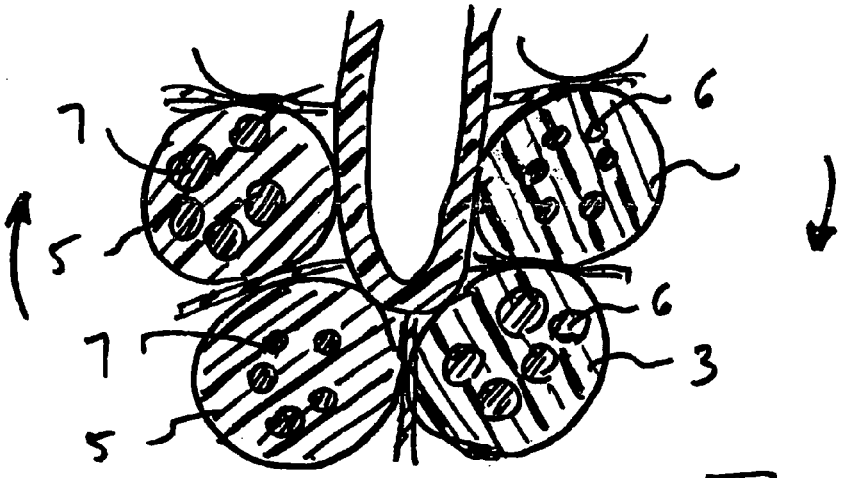
FIG. 3 is a view showing the electrical cable in accordance with another embodiment of the present invention.

FIG. 3 shows a different embodiment of the present invention. Here the diameter of the wires 6 in the bundles 3 in the plurality of bundles 2 increases in a first direction, for example in a clockwise direction, while the diameter of the wires 6 in the bundles 5 in the plurality of bundles 4 also increases in the same clockwise direction. These two different embodiments provide corresponding advantages for different applications of the inventive cable.

In accordance with a further feature of the present invention, the wires 6 in the bundles 3 of the plurality of bundles 2, and the wires 7 in the bundles 5 of the plurality of bundles 4 are twisted. In particular in opposite direction. More particularly, in each of two neighboring bundles the wires of different diameters are twisted in two opposite directions, as shown with the arrows in FIGS. 1 and 3.

In accordance with the present invention the sheaths 10 of the bundles are composed of different materials, for example different plastic materials. When the sheaths are composed of the same material as in the art, all sheaths 10 form a single plastic structure which worsens the parameters of the current transmission. When in accordance with the present invention the sheaths 10 are composed of different plastic materials, they do not form a single plastic structure and therefore the current transmission is improved.

Figure 4:
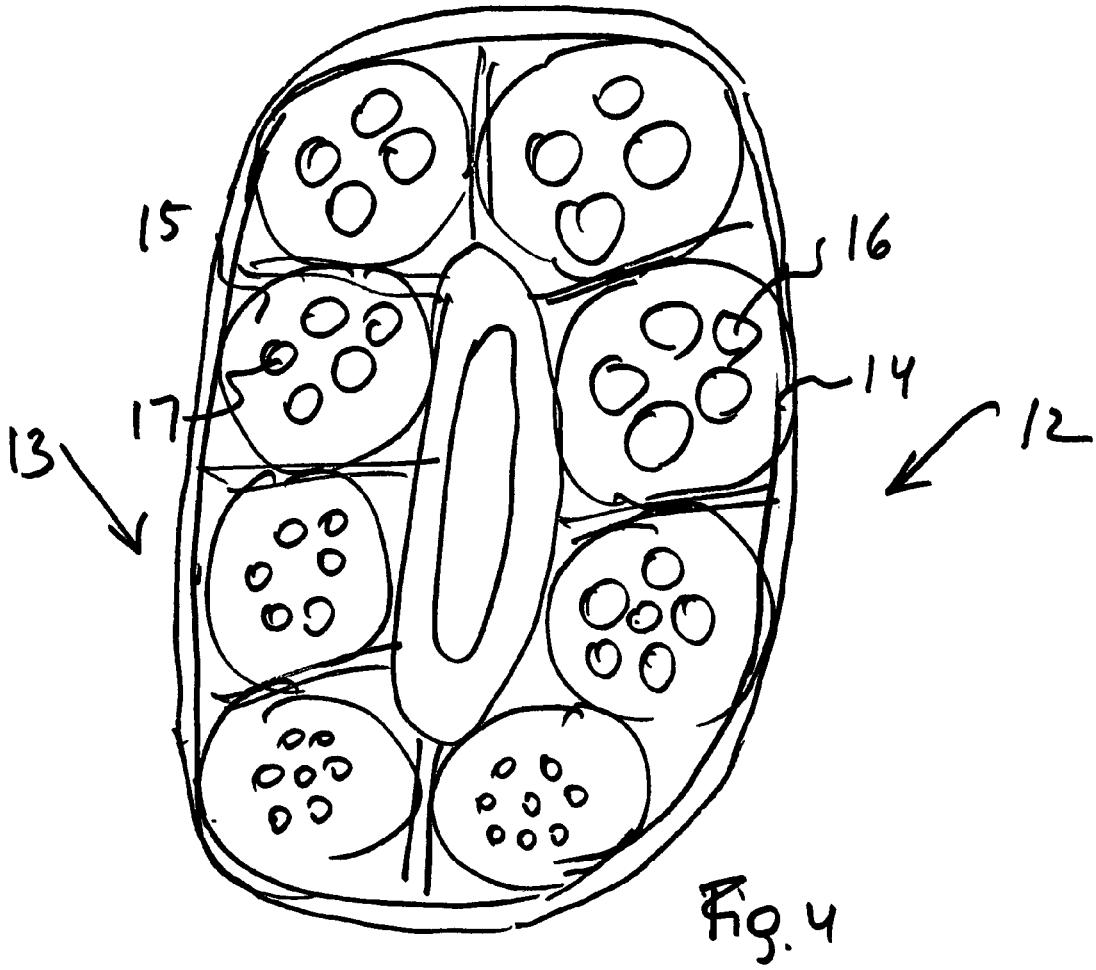
FIG. 4 is a view showing the electrical cable in accordance with still a further embodiment of the present invention.

In the embodiment shown in FIG. 4 the cable 11 has two pluralities 12 and 13 of bundles 14 and 15 with wires 16 and 17. The bundles 14 and 15 have the same diameters, the wires 16 and 17 have different diameters, and the numbers of wires 16 and 17 in the bundles 14 and 15 are different.

In general, when the cable is designed in accordance with the present invention, the speed of current transmission is increased and the quality of the current transmission is improved.

In accordance with the present invention it is further proposed to make sheaths on the bundles of different materials, so that two neighboring bundles have sheathes of different materials, for example of polyethylene and tetrafluorethylene. Thus, the sheath of a bundle with the wires of one diameter can be composed of one material, and the sheath of a bundle with the wires of a different diameter is composed of a different material, in alternating order. This prevents formation of a single-material uninterrupted sheath structure, which conventionally affects the transmission.

Instead or in addition to it, a separating element 18 can be provided between the bundles and composed of a different material than the sheaths of the bundles and the jacket. The separating element 18 can be a part of the central core, and even made of one piece with it.

Also, the jacket can be composed of a material which is different that the material of the sheaths of the bundles, for example of polypropylene. It is also possible to use all above features simultaneously, namely the sheaths of the bundles of different materials, the jacket of a different material than the sheaths, and the separating element of a different material.

The different materials which can be used for the jacket, the sheaths, the separating element can include polyethylene, polypropylene, kapton, teflon, nylon, neoprene, etc.

It will be understood that each of the elements described above, or two or more together, may also find a useful application in other types of constructions differing from the types described above.

While the invention has been illustrated and described as embodied in an electrical cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrical cable, comprising a first plurality of bundles located side-by-side adjacent to one another and each including a plurality of wires and connectable to a positive pole of a current source at one end; a second plurality of bundles located side-by-side adjacent to one another and each including a plurality of wires and connectable with a negative pole of the current source at one end; said bundles of said first plurality of bundles and said second plurality of bundles including bundles of same diameters, said wires in said bundles located side-by-side to one another having different diameters, and the wires of said bundles located side-by-side adjacent to one another are twisted in opposite directions so that the wires having a greater diameter of one bundle are twisted in one direction, while the wires having a smaller diameter of a neighboring bundle located side-by-side adjacent to said one bundle are twisted in an opposite direction, so that in one bundle of each of said plurality of bundles there are said wires of a greater diameter, while in another bundle of the same plurality of bundles located side-by-side adjacent to said one bundle there are said wires of a smaller diameter.

2. An electrical cable as defined in claim 1, wherein said wires in said bundles located side-by-side adjacent to one another in said first plurality of bundles and in said second plurality of bundles have an increasing diameter in opposite directions.

3. An electrical cable as defined in claim 1, wherein said wires in said bundles in said first plurality of bundles located side-by-side adjacent to one another have the diameters increasing in a first direction, while said wires in said bundles located side-by-side adjacent to one another in said second plurality of diameters have the diameters increasing in the same first direction.

4. An electrical cable as defined in claim 1, wherein the bundles of each of said plurality of bundles include identical numbers of wires.

5. An electrical cable as defined in claim 1; and further comprising a core located between said bundles of said first plurality of bundles and said bundles of said second plurality of bundles and substantially centrally of the cable.

6. An electrical cable as defined in claim 1, wherein each of said bundles have a sheath which covers it, said sheathes of different bundles being composed of different materials, so as to prevent formation of a single-material uninterrupted sheath structure.

7. An electrical cable as defined in claim 1, wherein the bundles of each of said plurality of bundles include different numbers of wires.

8. An electrical cable as defined in claim 1, wherein the different bundles located side-by-side adjacent to one another are provided with sheaths that are composed of different materials.

9. An electrical cable as defined in claim 1, wherein the bundles are provided with sheaths that are composed of a material which is different from a material of a jacket surrounding all the bundles.

10. An electrical cable as defined in claim 1; and further comprising a separating element located between the bundles and composed of a material which is different from a material of sheaths of the bundles.

11. An electrical cable as defined in claim 10, wherein said separating element is a part of a central core.

12. An electrical cable as defined in claim 1, wherein in each of said plurality of bundles located side-by-side adjacent to one another a diameter of said wires decreases from one of said bundles to a neighboring one of said bundles located side-by-side adjust to one another.

13. An electrical cable as defined in claim 1, wherein said wires of said bundles located side-by-side adjacent to one another are twisted in opposite direction, so that the wires having a greater diameter of one bundle are twisted in one direction, while the wires having a smaller diameter of a neighboring bundle located side-by-side adjacent to said one bundle are twisted in an opposite direction.

* * * * *